US006026864A

United States Patent [19]

Corain et al.

[11] Patent Number: 6,026,864

[45] Date of Patent: Feb. 22, 2000

[54] MODULAR DEVICE FOR WEFT YARN PRESENTATION IN SHUTTLELESS LOOMS

[76] Inventors: Luciano Corain; Luigi Corazzola; Giulio Bortoli, all of V.E. Romagna N°1-36015, Schio (Vi), Italy

[21] Appl. No.: 09/075,170

[22] Filed: May 11, 1998

[30] Foreign Application Priority Data

Jul. 30, 1997 [IT] Italy ..... MI97A1821

[51] Int. Cl.[7] ..... D03D 47/00; D03D 47/38

[52] U.S. Cl. ..... 139/449; 139/453

[58] Field of Search ..... 139/449, 429, 139/302, 122 R, 444, 450, 453; 66/125 R, 127, 133, 138

[56] References Cited

U.S. PATENT DOCUMENTS

| | | | |
|---|---|---|---|
| 3,605,444 | 9/1971 | Lonati | 66/133 |
| 4,132,249 | 1/1979 | Bolea Camprubi . | |
| 4,998,420 | 3/1991 | Scavino | 66/138 |
| 5,400,834 | 3/1995 | Lewyllie | 139/453 |

FOREIGN PATENT DOCUMENTS

| | | |
|---|---|---|
| 0 461 524 | 12/1991 | European Pat. Off. . |
| 25 02 466 | 7/1976 | Germany . |
| 09268453 | 10/1997 | Japan . |
| 418 249 | 10/1964 | Switzerland . |
| 2 059 459 | 4/1981 | United Kingdom . |

*Primary Examiner*—John J. Calvert
*Assistant Examiner*—Robert H. Muromoto, Jr.
*Attorney, Agent, or Firm*—Nixon & Vanderhye

[57] ABSTRACT

A modular device for weft yarn presentation in a shuttleless loom, operated by linear electric motors which present the yarn by using rods mounted on sliders which rotate to transition the rods from raised standby positions to lowered delivery positions. The linear motors include fixed plates and pivotally mounted sliders, each carrying a rod. The fixed plates are assembled such that the plates angularly diverge from one another from adjacent the pivotal mounting between the sliders and plates and form acute angles therebetween. By using this arrangement, the delivery segment for the yarns is significantly shorter and the angle of presentation of the yarns is substantially narrower.

6 Claims, 6 Drawing Sheets

Fig.3C
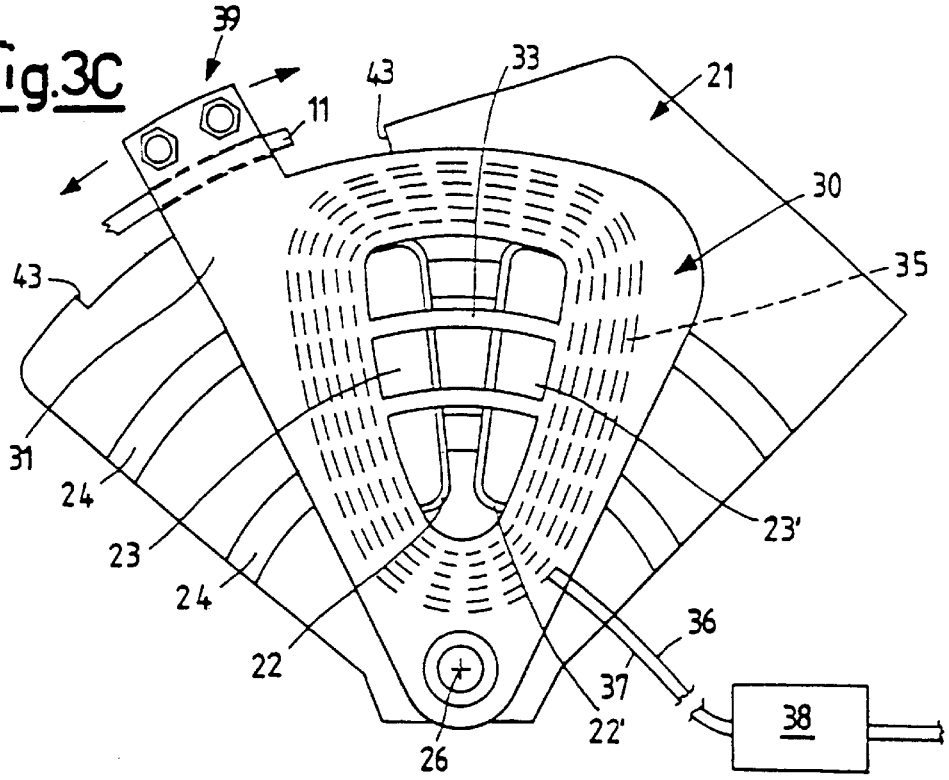
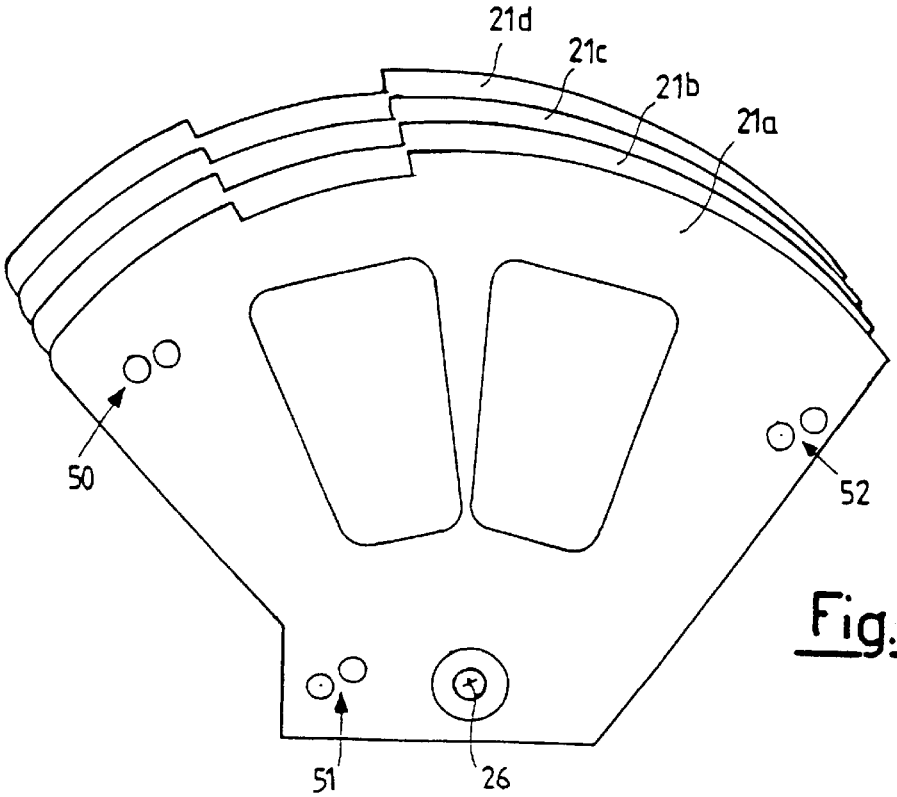
Fig.4A

MODULAR DEVICE FOR WEFT YARN PRESENTATION IN SHUTTLELESS LOOMS

BACKGROUND OF THE INVENTION

This invention relates to a modular device for weft yarn presentation in shuttleless looms.

More specifically, the invention relates to a device for presenting the weft yarns to the grippers of shuttleless looms in which the various yarns carried into operation are presented within a narrow space interval to the gripper which inserts them into the shed.

To better illustrate the technical problem faced by this invention, together with the particular difficulties and requirements of shuttleless looms, reference is made hereinafter to the method of weft yarn presentation in such looms which is illustrated schematically in FIGS. 1 and 2.

FIG. 1A shows to the right the already produced fabric 1 and the shed open in the two planes 2 and 3 by the movement of the heddles, not shown in the figures for simplicity. Each time the shed opens, and with suitable synchronism, one or more weft yarns are inserted into it depending on the fabric pattern to be produced, this yarn or these yarns being delivered to a gripper 4 which is propelled and guided into the shed by a semirigid tape 5 which winds and unwinds with reciprocating rectilinear movement in the direction of the double arrow 6 by the effect of the reciprocating rotary movement, in the direction of the arrow 7, of lateral operating wheels 8 which are precision-controlled in terms of times, excursion and velocity. In the most widely used looms the weft yarn insertion gripper consists in reality of a pair of grippers which move starting from the two sides of the fabric, to meet in the middle where that gripper which has taken the yarn from the presentation device, and has completed its travel along one half of the width of the fabric, transfers it to the gripper on the other side, which turns back to complete its travel along the other half of the fabric width. The weft yarn inserted in this manner into the shed is incorporated into the fabric by the beating of the reeds, not shown in the figures for simplicity. During its reciprocating rectilinear movement the gripper 4 moves along the dashed-line horizontal trajectory 9.

The plurality of weft yarns which are to be inserted and woven with the warp yarns to form the fabric are contained on bobbins 10. FIG. 1A shows only four bobbins 10*a, b, c, d* for simplicity of drawing, however they are present in a greater number, generally eight but in certain cases more.

The weft yarn is presented to the gripper 4 by presentation rods 11*a, b, c, d*—again only four are shown for simplicity—which receive their weft yarn 12*a, b, c, d* from the respective bobbin 10*a, b, c, d*, after passage through the respective yarn feelers 13*a, b, c, d*. The presentation rods 11 are each provided with an end eyelet through which the respective weft yarn 12 passes. These rods can move between two positions, namely an upper rest position and a lower position in which they deliver the respective weft yarn to the gripper 4. In FIG. 1A the rods 11*a, c, d* are in their upper position and maintain the respective yarn out of range of the gripper, whereas the rod 11*b* is in its lower position in which it delivers the yarn 12*b* to the gripper 4 which is still retracted towards its propelling wheel 8 but is about to arrive at the position in which it grips the weft yarn.

The rods 11, for example the rod 11*b* in FIG. 1, move into their lowered delivery position to rest their yarn on a stop bar 14, so that the various weft yarns presented one by one to the gripper 4 lie in the generally horizontal plane defined by the upper edge of the bar 14 and the vertex 15 of the shed, in which region all the weft yarns of the fabric under production converge. By suitably adjusting the level of the bar 14, this plane can be made to contain the trajectory line 9 of the gripper 4, so that the gripper necessarily encounters the yarn presented to it at the appropriate time by one of the rods 11.

FIG. 1B schematically shows the situation after the yarn has been gripped by the gripper which has advanced along the line 9 towards the open shed. Downstream of the position in which the yarn is presented there is a cutting member 16, here indicated conventionally as scissors, which intercepts that portion of weft yarn lying between the moving gripper 4 and the vertex 15, to cut it with appropriate synchronism so that the weft yarn carried into the open shed is that which unwinds from its bobbin 10, and does not involve yarn on the same side as the already produced fabric. In FIG. 1A the scissors are shown open whereas in FIG. 1B they are shown closed with the yarn 12 cut.

To better illustrate the requirements of gripper looms and the characteristics and advantages of this invention, reference will now be made to FIGS. 2A and 2B, which show respectively in transverse view and plan view the configuration shown in perspective view in FIG. 1.

FIG. 2A shows the rods 11*a, c, d* maintaining the respective weft yarns 12*a, c, d* raised, whereas the rod 11*b* is lowered with its yarn 12*b* resting on the bar 14. This yarn joins the edge of the bar 14 to the vertex 15. This configuration is shown in plan view in FIG. 2B, which shows the various lowered positions A, B, C, D in which the various rods 11 deliver their yarn to the gripper when they are lowered by the action of the presentation unit 17, consisting of a plurality of actuators 17*a, b, c, d* which lower and raise their rod 11*a, b, c, d* when it is the turn of their yarn, again considering that in effect the number of yarns, bobbins, yarn feelers and rods is greater, and normally eight or more.

As shown in FIGS. 1 and 2, the rods 11 project with progressively increasing length and height from 11*a* to 11*d*, to maintain the various weft yarns at a greater distance apart when in their standby position. In this respect, each yarn to be presented must be lowered with reliability by operating its rod, without also presenting one of the yarns of the adjacent rods by the effect of the hairiness of or electrostatic charges on the yarns. As a result of this arrangement the points A, B, C, D representative of the plurality of weft yarn presentation members are shown as a segment inclined to the working line 9 of the gripper 4.

The delivery of the weft yarn is progressively more difficult from the first yarn 12*a* to the last yarn 12*d*, this number being shown for ease of drawing, however in fact they are of a greater number. As can be clearly seen from FIG. 2B, the yarn 12*a* is encountered by the gripper at the point A' and lies at a very acute angle to the trajectory 9, whereas the last yarn 12*d* is encountered by the gripper at the point D' and lies at a considerably less acute angle to the trajectory 9.

In this respect it must be noted that such a gripper 4 is currently constructed with the precise requirement of gripping only those yarns which it encounters at a narrow angle, whereas it does not grip any yarns which it encounters at a right angle or an angle which is not narrow. This corresponds to the requirement that, should the shed not be perfectly open and any warp yarn is not completely raised or lowered, the gripper 4 must not grip it and pull it, but only shift it from its path, to raise it or lower it into the required position. Under such conditions those yarns more to the left in FIG. 2B have a greater probability of being gripped correctly, whereas the yarns more to the right have a greater uncertainty of correct outcome of the operation.

A further uncertainty in the proper gripping of those weft yarns more to the right on the drawing by the gripper is due to the fact that during gripping, the gripper is under considerable acceleration. It must be noted that in looms of the type under consideration, the frequency of the weaving cycle is currently of the order of 600–700 beats per minute and hence the gripper must travel from rest, arrive at the middle of the width of the fabric, halt with precision to deliver the yarn to the opposite gripper and then withdraw without yarn, all within a total time of less than one tenth of a second. Under such circumstances those yarns more to the right are intercepted by the gripper at a much higher speed than the yarns more to the left, they hence being more stressed and thus gripped with less precision.

The technical problem of improving the operation of presenting the weft yarn and the device which performs this weaving stage in shuttleless gripper looms is hence essentially to shift the segment A'–D' towards the left and to shorten the length s. In FIG. 2B this represents that length of the gripper path along which the various weft yarns are presented. There is also the requirement to reduce as much as possible the width of the angle $\alpha$ which in FIG. 2B comprises the bunch of straight lines joining the point 15 to the points A–D, these representing the lowering of the weft yarn by the rods 11*a–d* for delivery, while however satisfying the requirement that when in the raised standby position the ends of the rods 11 must be properly separated so as not to also involve undesired adjacent yarns during lowering. This invention is defined in terms of its salient characteristics in claim 1. It is described hereinafter with reference to a typical embodiment illustrated by way of non-limiting example in FIGS. 3 to 6.

BRIEF SUMMARY OF THE INVENTION

In a preferred embodiment according to the present invention, there is provided a weft yarn presentation device in a shuttleless loom, comprising a plurality of presentation devices, one for each weft yarn, the presentation devices including linear electric motors each having a fixed plate carrying permanent magnets and a rotary slider mounting a rod rigidly connected to the slider and rotatable with said slider to present a weft yarn carried by an end thereof, the sliders being pivotally mounted to said fixed frames, respectively, for rotating about an axis, the rod ends being maintained separated from one another in raised positions thereof to maintain the weft yarns carried thereby separated from one another and movable into lowered delivery positions for presenting yarns to a gripper, the positions being spaced closer to one another than the raised positions, each slider carrying a projecting element carrying the weft yarn presentation rod, the fixed frame plates lying in respective planes and being assembled such that the plates angularly diverge from one another from adjacent the pivotal mounting between the sliders and the frames and form acute angles therebetween.

BRIEF DESCRIPTION OF THE DRAWINGS

FIG. 3C is a plan view illustrating the slider of FIG. 3A superposed on the plate of FIG. 3A;

FIG. 4A illustrates a diverging arrangement of the fixed plates in the linear motor assembly;

DETAILED DESCRIPTION OF THE INVENTION

The weft presentation device of this invention uses linear electric motors for operating the presentation levers 11. The structure of these motors is shown schematically in FIGS. 3A and B. They are well known in the art and are widely applied in various industrial and textile fields, they being described for example in Italian Patent 1,217,872 or the corresponding European Patent Application 347,626 in the name of Scavino, and in Italian Patent 1,248,715 in the name of Vamatex or the corresponding European Patent Application 461,524. In this latter European Patent Application the weft presentation device operates by means of presentation rods which move translationally by converting the reciprocating rotation of the linear electric motor into reciprocating rectilinear movement using interposed flexible cables sliding within guide sheaths.

Figure 1A:
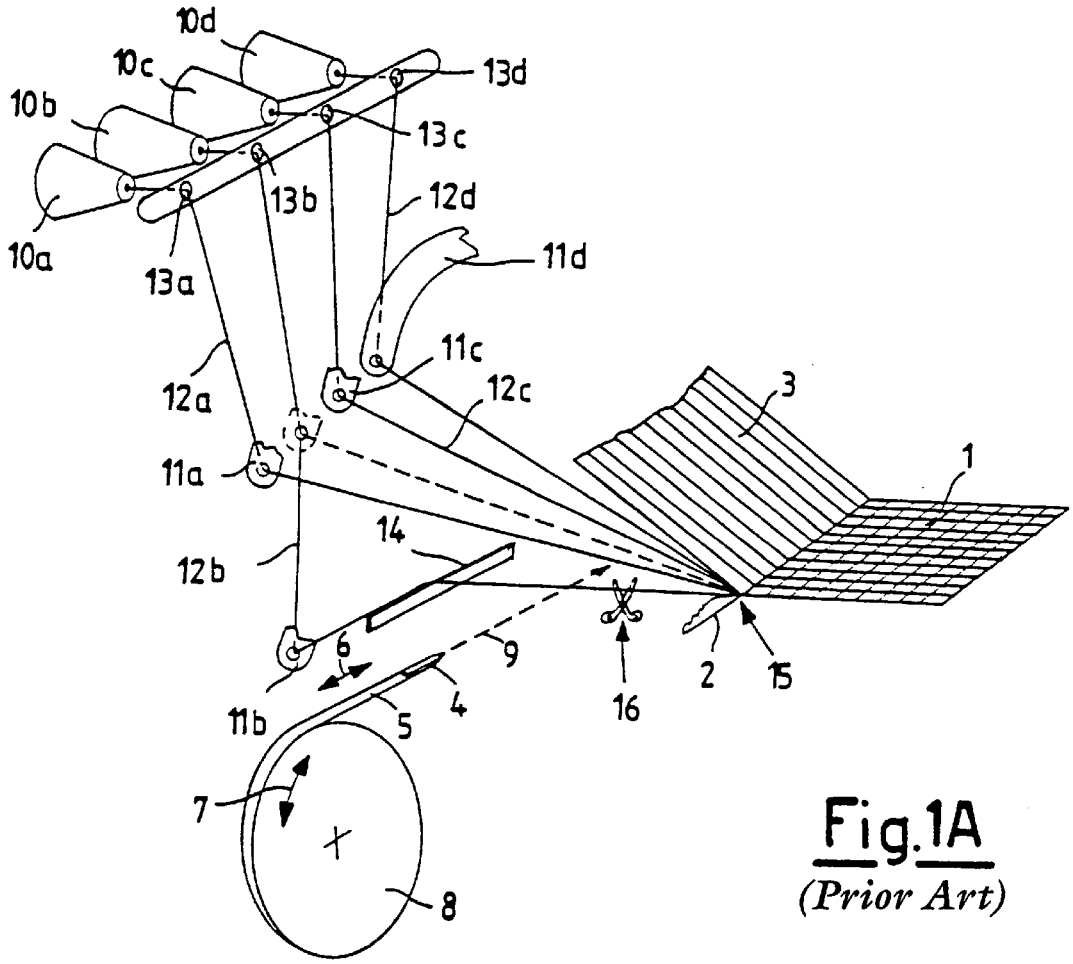
Fig.1A (Prior Art)
FIGS. 1A and 1B are schematic illustrations of prior art shuttleless looms.
Figure 1B:
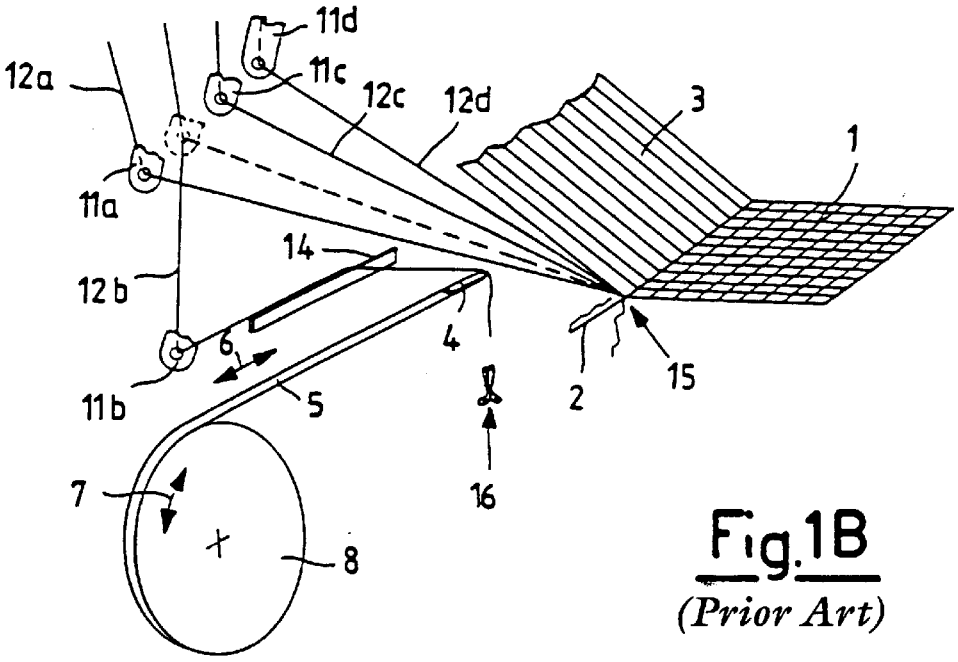
Fig.1B (Prior Art)
Figure 2A:
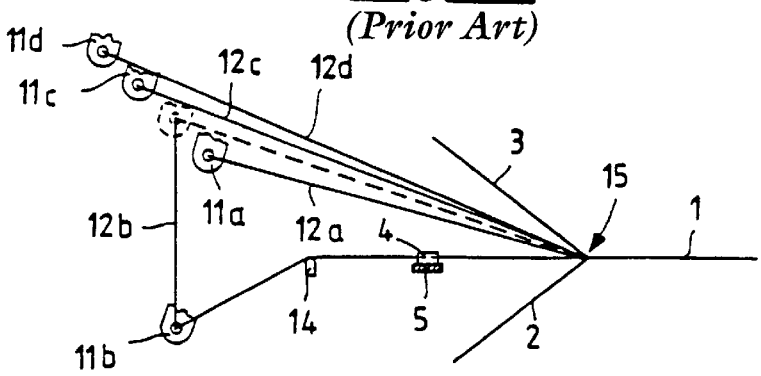
Fig. 2A (Prior Art)
FIGS. 2A and 2B are respective side elevation and plan views of the shuttleless loom illustrated in FIGS. 1A and 1B.
Figure 2B:
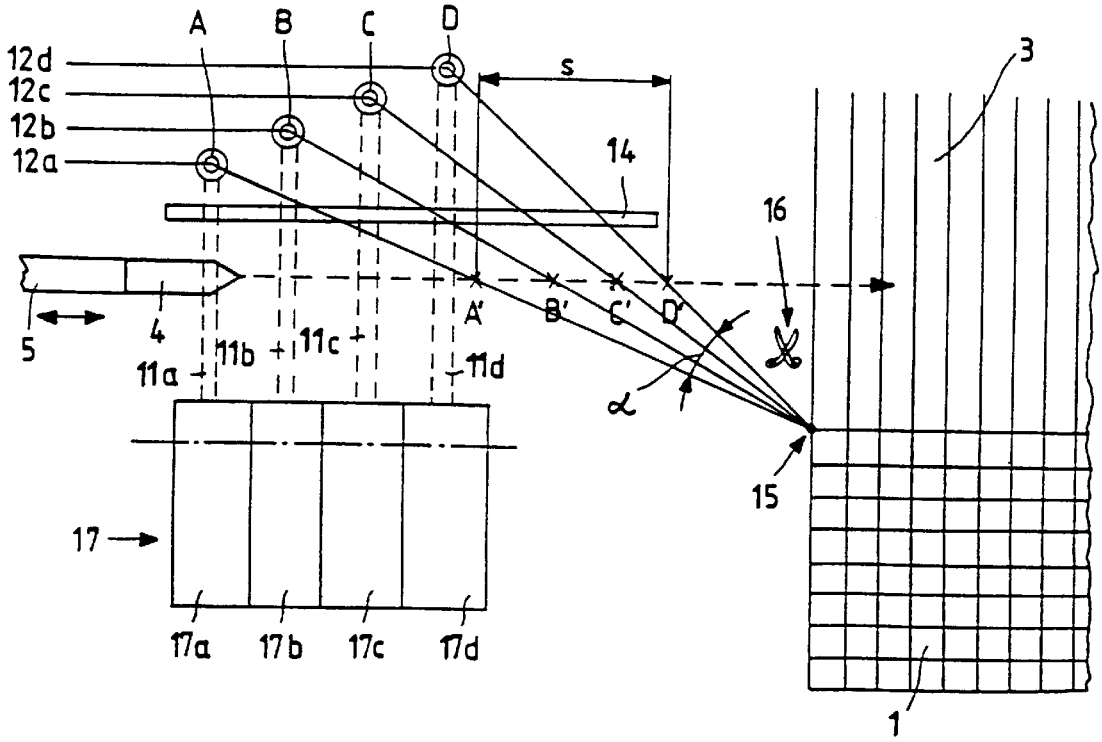
Fig. 2B (Prior Art)
Figure 3A:
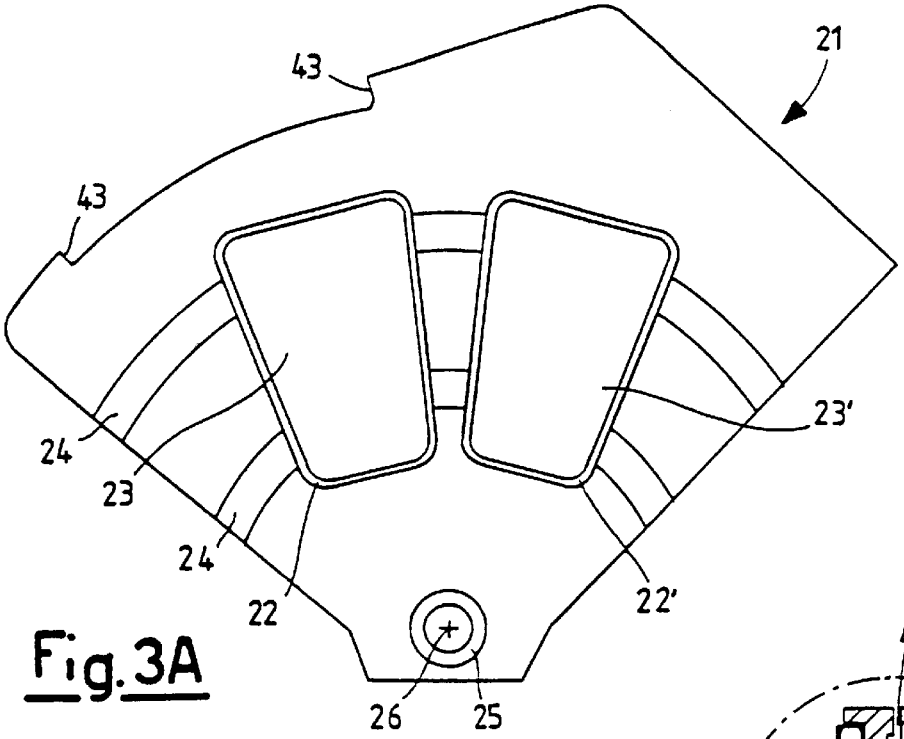
FIG. 3A is a plan view of a fixed frame forming a portion of a linear motor employed in the present invention.
Figure 3D:
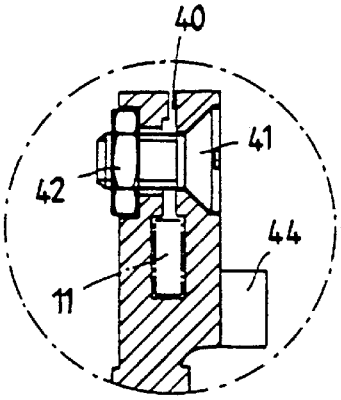
FIG. 3D is an enlarged crossed-sectional view of the circled portion looking from right to left in FIG. 3B.

The linear motor used consists of a fixed frame 21 in the form of a plate of non-magnetic material, comprising two housings 22 and 22' into which two plate permanent magnets 23 and 23' respectively are inserted, as shown in FIG. 3A. These permanent magnets are located and fixed in their housing in such a manner as to present on that surface facing the moving element, which can for example be the surface of the drawing, a polarity which in one case is positive and in the other case negative. On the fixed frame plate 21 there are provided projections 24 acting as spacers for its slider or moving element, and a hole 25 for applying the connection to the moving element 30 for rotation about the centre 26.

Figure 3B:
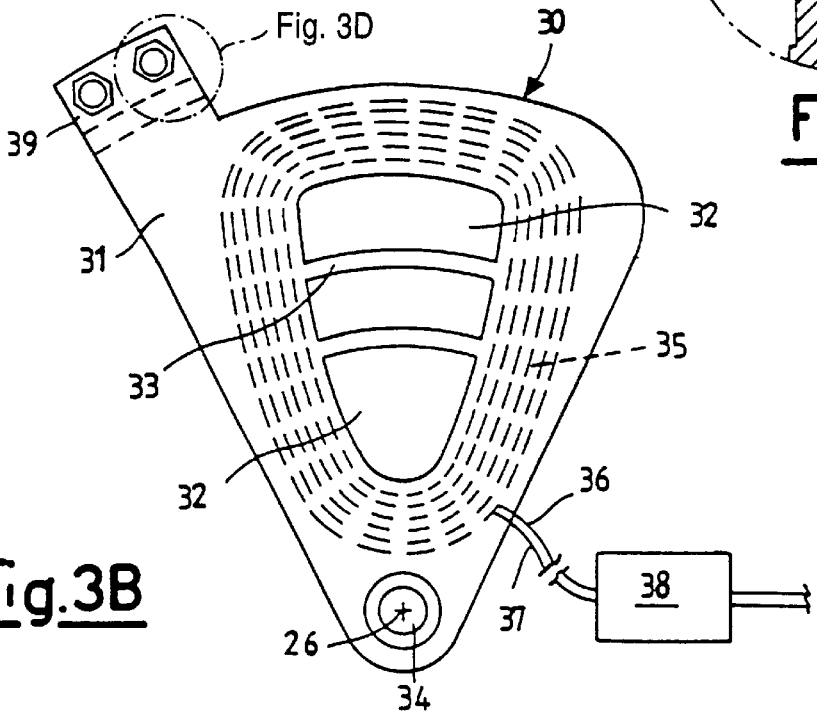
FIG. 3B is a plan view of a slider used in conjunction with the plate of FIG. 3A.

As shown in FIG. 3B, the moving element 30 consists of a flat body 31 of material which is not electrically conducting, for example a polymer of good mechanical characteristics, with lightening holes 32 and stiffening ribs 33 which also act as spacers similar to the projections 24 on the fixed frame. The moving element or slider is also provided with a hole 34 for applying the connection to the frame 21, for example a pin and ball bearing of known type, and for rotation about the centre 26. Within the flat body of the slider 30 there is incorporated a closed flat winding 35 connected by wires 35, 37 to a switch/modulator 38 for a d.c. electric power supply which energizes the winding 35 with current of reversible direction, to hence generate controllable magnetic forces of opposite polarity on the slider faces. At a vertex of the slider distant from the pin which connects it to its frame there is a projecting element 39 provided with a system for its adjustable fixing to the weft yarn presentation rod 11, for example by inserting the rod into a slot 40 provided in the projection and pressure-locking the rod 11 between its two parts with bolts 41 and nuts 42. The slider is driven by energizing its winding, its amplitude being controllable electronically.

The operation of a linear motor consisting of a fixed plate coupled to its slider is very simple and amply described in the known art, for example in the cited Italian Patent 1,217,872. Position changes are determined by feeding direct current to the winding 35 to hence induce a magnetic force which attracts the slider towards one of the magnets 23, 23' and repels it from the other, depending on the direction of the current fed to the winding. To maintain its position it is merely necessary to circulate a weak current always in the same direction.

FIG. 3C shows the linear motor assembled. The rod 11 is clamped within the slot 40 so that the rod projects from the element 39 to a greater or lesser extent depending on its position in the sequence in which the rod is mounted in the presentation device of the invention, which is formed by combining a plurality of linear presentation motors as illustrated in FIGS. 3A, B, C.

Figure 4B:
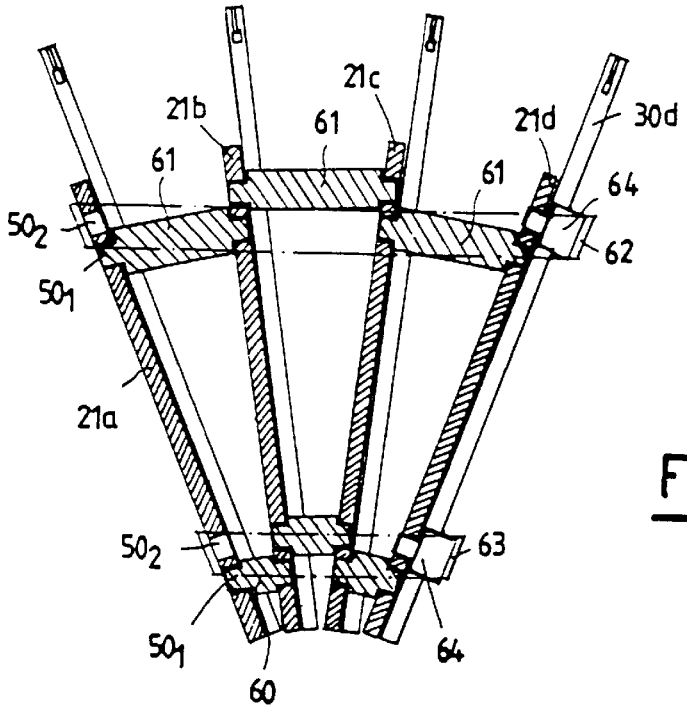
FIG. 4B is a cross-sectional illustration of the fixed plates and sliders in their divergent relationship.
Figure 6:
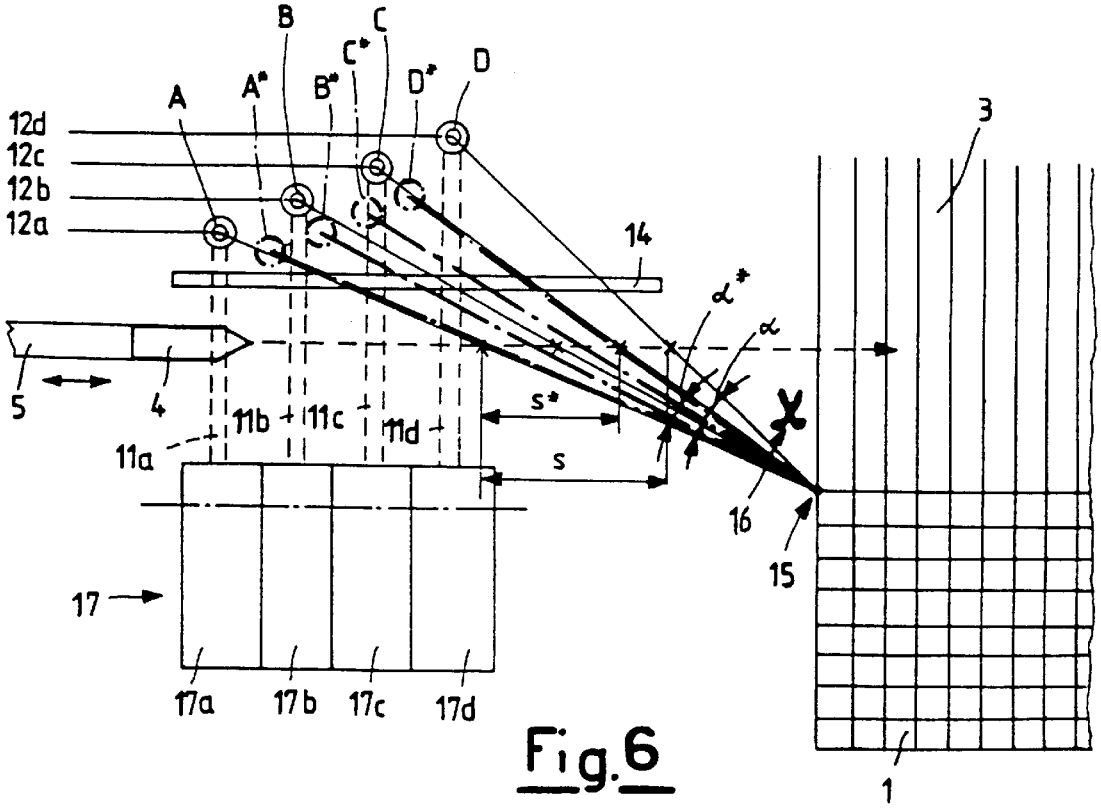
FIG. 6 is a schematic illustration of a further form of the present invention.
Figure 5:
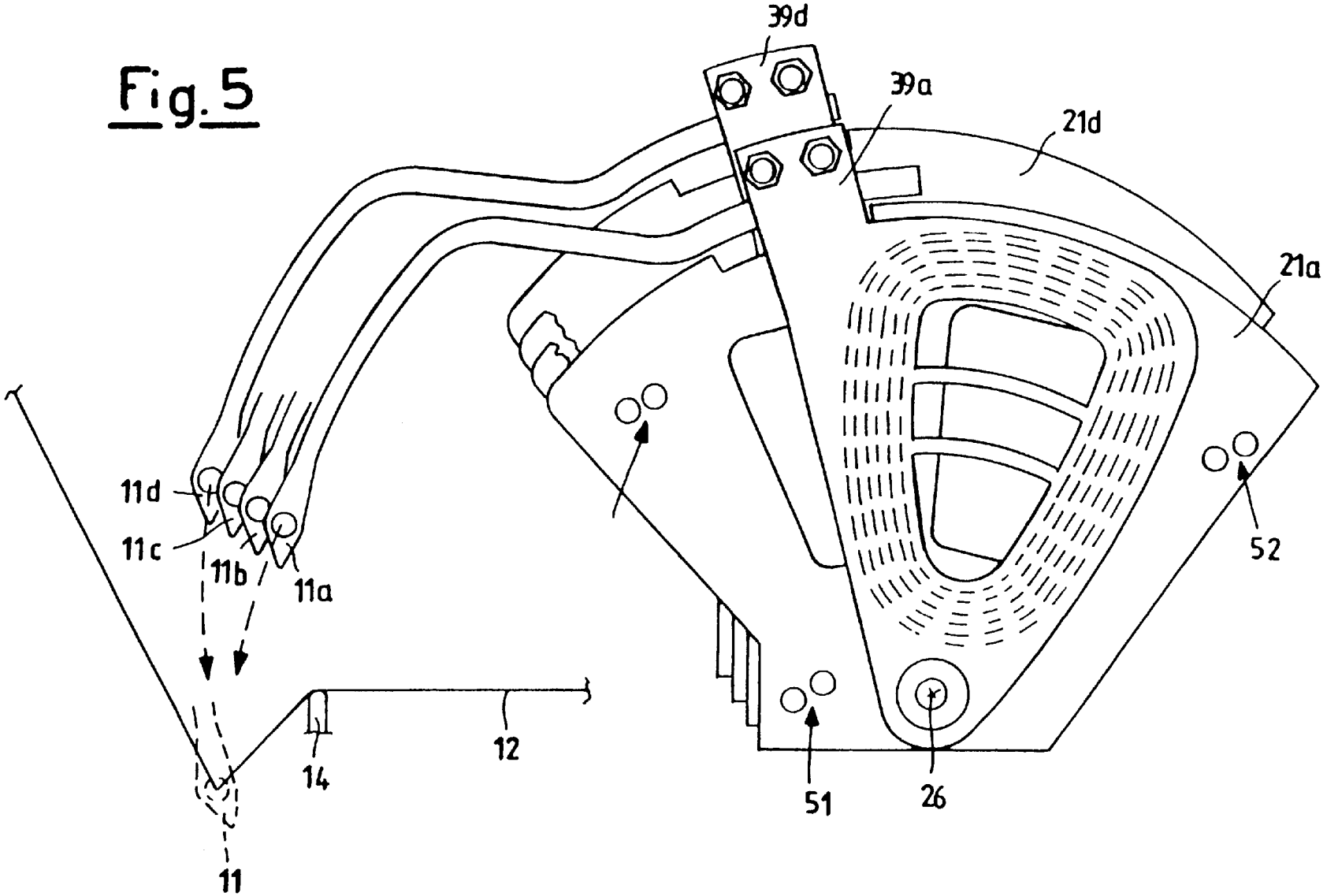
FIG. 5 is a schematic illustration showing the rods in a standby position with one rod in the presentation position.

The method of assembling these components to form the presentation device is one of the salient characteristics of the invention, this consisting of mounting the various linear motors of the device angularly offset one from another, the linear motors formed by the plates 21 and sliders 30 being mounted to form a V one to another to give an overall "semi-open book" shape to the linear motors, as shown in FIGS. 4 to 6.

With this mounting arrangement, the sliders rotate about their centre 26 within rotational planes which are angularly offset one to another.

As shown in FIG. 4A, in which the frame plates 21*a, b, c* . . . are shown in front view without their moving slider 30*a, b, c* . . . , two or more sets of two or more through holes 50,51,52 are provided in the frame plates 21 of each linear motor in peripheral positions not influenced by the movement of their slider 30, to enable the various plates 21 to be assembled in V pattern within said rotational planes, by connecting two holes together at a time as described hereinafter by way of example.

The three holes $\mathbf{50}_1$, $\mathbf{51}_1$, $\mathbf{52}_1$ of the plate 21*a* are superposed on the holes $\mathbf{50}_1$, $\mathbf{51}_1$, $\mathbf{52}_1$ of the plate 21*b*, through the three alignments of said holes there being inserted spacer pins consisting of two cylindrical end parts which penetrate as an exact fit into the holes 50, 51, 52 and have an enlarged intermediate part forming a spacer between the various frame plates. To fix the plate 21*b* to the plate 21*c* the respective holes $\mathbf{50}_2$, $\mathbf{51}_2$, $\mathbf{52}_2$ are used.

As shown in FIG. 4B, this assembly is achieved using pins 60, 61 with a cylindrical intermediate part—serving as a spacer between the various frame plates 21—of different length, using pins 60 with shorter spacers for the part closer to the centre of rotation 26 and pins 61 with longer spacers for those parts more distant from said centre of rotation.

The width of the assembly angle between adjacent plates preferably lies within the range 0°–10°, with a total angle between the end plates within the range 0°–90°, considering the actual number of plates to be mounted.

The plates 21 positioned in this manner are locked by known means, for example by two C-shaped brackets 62, 63 which connect together the end plates, but with an end spacer 64 interposed in order not to hinder the rotary movement of the last slider 30*d*.

FIG. 5 shows the overall assembly of the weft presentation device. To obtain the required distance between the weft yarns when in their rest position, in a preferred embodiment of the invention the various rods 11 are made all equal, but are mounted within their support 39 such that they project by progressively increasing lengths from 11*a* to 11*d*, according to the sequential position in the mounted presentation device, and always considering that they are shown as four in number for simplicity, but are in fact of a greater number.

If the angle between the motor plates, one to another, is as shown in FIG. 4B, it is apparent that the rods 11 rotate towards the yarn presentation position within planes which approach each other in proceeding downwards along the dashed lines. The rods 11, of which a generic rod is shown in FIG. 5 in its lowered weft yarn delivery position, mutually converge, with a considerable effect of mutual approach of the weft yarn presentation points A*-B*-C*-D*, as shown in FIG. 6.

Compared with the situation of the known art shown in FIG. 28, the delivery segment s* for the yarns 12*a–d* is significantly shorter, and the angle $\alpha^*$ containing the bunch of straight lines joining the point 15 to the points A*-B*-C*-D*, which represent the lowering of the weft yarn into the delivery position by the rods 11*a–d*, is substantially narrower.

In a modified embodiment of the invention the fixed plates 21 can be assembled again in book form but using for the holes 52, ie those located in that upper edge most distant from the yarn presentation position, pins 61 having longer spacers than those of the pins 61 used for the holes 50, ie those located in that upper edge closest to the yarn presentation position. This method of assembling the plates 21 has an effect on the position of the line of intersection of the planes of the plates 21, which is no longer horizontal but is raised at the end closer to the holes 50 and lowered at that end closer to the holes 52, and further enhances the effect of mutual approach of the weft yarn delivery positions A*-B*-C*-D*, by further shortening the segment s* and making the angle $\alpha^*$ even more narrow.

It should also be noted that the invention is also able to achieve both a reduction in the range of the weft yarn presentation positions—starting from a given stepping of the yarn standby positions—and a greater spacing between the yarns when at rest—for the same range of positions of weft yarn presentation to the gripper.

According to a further embodiment of the invention, the frame plates 21 can be assembled both with different projection distances of the rod 11 and with different angles between the plates 21, so as to provide one or more weft presenters with greater spacing when in the standby position, to accommodate possible yarns which are more likely to tangle with others, while still using identical components but mounting them differently. Compared with weft yarn presentation devices of the known art, the device of the invention offers considerable advantages both in performance and in construction. In this respect, the device is constructed with rigid connections and, for yarn presentation, does not use flexible members interposed between the linear motor and the yarn guide rod. Such an interposing could result in a decrease in overall performance compared with the performance offered by the linear motor, such as velocity, acceleration, deceleration, time and angular position control.

With such an arrangement, during each presentation cycle the flexible member deforms to produce substantial friction within its guide sheath, compared with a yarn guide operated only as required. This circumstance is significant in the light of the performance required of the device. It must operate at a high presentation rate, with a frequency of 600–700 beats per minute, and with a precise trajectory in order not to involve adjacent yarns.

We claim:

1. A weft yarn presentation device in a shuttleless loom, comprising a plurality of presentation devices, one for each weft yarn, said presentation devices including linear electric motors each comprised of a fixed plate carrying permanent magnets, a rotary slider, and a rod rigidly connected to said slider and rotatable with said slider to present a weft yarn carried by an end thereof to a gripper, said sliders being pivotally mounted to said fixed plates, respectively, for rotation about respective axes in planes substantially parallel to planes containing said respective plates, said rod ends being maintained separated from one another in raised positions thereof to maintain the weft yarns carried thereby separated from one another and movable into lowered delivery positions for presenting yarns to the gripper, said lowered positions being spaced closer to one another than said raised positions, each said slider having a projecting element carrying said weft yarn presentation rod, said fixed plates being assembled to another such that the plates and planes contained therein angularly diverge from one another from adjacent said pivotal mounting between said sliders and said plates and form acute angles therebetween.

2. A weft yarn presentation device according to claim 1 wherein each said projecting element has an adjustable mount for the weft yarn presentation rod for projecting said rod to a greater or lesser extent from said element according to the sequential mounting position of said rod within the presentation devices.

3. A weft yarn presentation device according to claim 1 including through holes in said plates for assembling the plates to form said plate assembly, pins having intermediate spacer parts of different lengths for engaging in said holes with shorter spacer parts between holes adjacent said pivotal mounting and longer spacer parts between said holes further from said pivotal mounting.

4. A weft yarn presentation device according to claim 3 wherein said plates have angles between adjacent plates in the range 0°–10°, the total angle between end plates in the assembly of said plates being within the range of 0°–90°.

5. A weft yarn presentation device according to claim 3 wherein said different length-spacers between said plates are located such that a line of intersection of the planes of said plates lies raised at an end closer to the yarn presentation position and lowered at an opposite end.

6. A weft yarn presentation device according to claim 3 wherein said frame plates have first and second pin receiving holes, said first pin receiving holes being located further from the yarn presentation position and receiving pins having longer spacer parts than said second pins received in holes located closer to the yarn presentation position.

* * * * *